US011401582B2

(12) United States Patent
Shibayama et al.

(10) Patent No.: US 11,401,582 B2
(45) Date of Patent: Aug. 2, 2022

(54) NI-BASED FORGED ALLOY ARTICLE AND TURBINE HIGH-TEMPERATURE MEMBER USING SAME

(71) Applicant: Mitsubishi Heavy Industries, Ltd., Tokyo (JP)

(72) Inventors: Takashi Shibayama, Yokohama (JP); Shinya Imano, Yokohama (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 707 days.

(21) Appl. No.: 16/325,081

(22) PCT Filed: Nov. 17, 2017

(86) PCT No.: PCT/JP2017/041428

§ 371 (c)(1),
(2) Date: Feb. 12, 2019

(87) PCT Pub. No.: WO2019/097663

PCT Pub. Date: May 23, 2019

(65) Prior Publication Data

US 2021/0388467 A1 Dec. 16, 2021

(51) Int. Cl.

| | |
|---|---|
| ***C22C 19/05*** | (2006.01) |
| ***C22F 1/10*** | (2006.01) |
| ***F01D 5/28*** | (2006.01) |

(52) U.S. Cl.

CPC ..... *C22C 19/057* (2013.01); *C22C 19/056* (2013.01); *C22F 1/10* (2013.01); *F01D 5/28* (2013.01)

(58) Field of Classification Search

CPC ..... C22C 19/056; C22C 19/057; C22F 1/10
See application file for complete search history.

(56) References Cited

U.S. PATENT DOCUMENTS

| | | | | |
|---|---|---|---|---|
| 4,574,015 | A | 3/1986 | Genereux et al. | |
| 5,759,305 | A | 6/1998 | Benz et al. | |
| 2004/0076540 | A1* | 4/2004 | Imano | B23K 35/3033 420/450 |
| 2009/0104040 | A1 | 4/2009 | Imano et al. | |
| 2010/0329876 | A1 | 12/2010 | Bain et al. | |
| 2011/0011500 | A1 | 1/2011 | Mannan | |
| 2011/0052443 | A1 | 3/2011 | Hanlon et al. | |
| 2011/0203707 | A1* | 8/2011 | Mourer | C22F 1/10 148/677 |
| 2012/0282106 | A1 | 11/2012 | Goller et al. | |
| 2015/0368774 | A1 | 12/2015 | Ota et al. | |
| 2016/0160334 | A1 | 6/2016 | Imano et al. | |
| 2020/0131614 | A1 | 4/2020 | Ota et al. | |

FOREIGN PATENT DOCUMENTS

| | | | |
|---|---|---|---|
| CN | 101868559 | A | 10/2010 |
| CN | 102764891 | A | 11/2012 |
| CN | 105200268 | A | 12/2015 |
| CN | 106636848 | A | 5/2017 |
| CN | 107299305 | A | 10/2017 |
| ER | 0 248 757 | A | 12/1987 |
| JP | 60-228659 | A | 11/1985 |
| JP | 9-302450 | A | 11/1997 |
| JP | 2011-12345 | A | 1/2011 |
| JP | 2011-52323 | A | 3/2011 |
| JP | 2012-177370 | A | 9/2012 |
| JP | 2016-3374 | A | 1/2016 |
| JP | 5869624 | B2 | 2/2016 |
| JP | 2016-104911 | A | 6/2016 |
| WO | WO 2015/008343 | A1 | 1/2015 |

OTHER PUBLICATIONS

Japanese-language Office Action issued in Japanese Application No. 2019-506214 dated Apr. 7, 2020 with English translation (nine (9) pages).

International Search Report (PCT/ISA/210) issued in PCT Application No. PCT/JP2017/041428 dated Feb. 20, 2018 with partial English translation (four (4) pages).

Hindi-language Office Action issued in Indian Application No. 201917003907 dated Dec. 23, 2020 with English translation (5 pages).

Korean-language Office Action issued in Application No. 10-2019-7004144 dated Mar. 27, 2020 with English translation (eight (8) pages).

Chinese-language Office Action issued in Chinese Application No. 201780050325.2 dated Jul. 8, 2020 with English translation (12 pages).

Extended European Search Report issued in European Application No. 17920616.4 dated Mar. 13, 2020 (11 pages).

Law C. et al., "Reduction of Strategic Elements in Turbine Disk Alloys", Feb. 28, 1981, pp. 1-51, XP055674395 (56 pages).

McTiernan B., "Powder Metallurgy Superalloys". Aug. 28, 2015, ATI Powder Metals , vol. 7, ASM Handbook, XP055674399 (20 pages).

(Continued)

*Primary Examiner* — Jessee R Roe
(74) *Attorney, Agent, or Firm* — Crowell & Moring LLP

(57) ABSTRACT

An objective of the invention is to provide a Ni-based forged alloy article based on a superhigh precipitation-strengthening Ni-based alloy material that has mechanical properties balanced at higher level than before, and a turbine high-temperature member formed of the forged alloy article. There is provided a Ni-based forged alloy article comprising crystal grains of the γ phase and precipitation particles of the γ' phase, and having a chemical composition enabling to precipitate a γ' phase in an amount of 50-70 volume % at 700° C. within a matrix of a γ phase. The γ' phase comprises: aging precipitation γ' phase particles precipitating within the γ phase grains; and eutectic reaction γ' phase particles precipitating between/among the γ phase grains. The eutectic reaction γ' phase particles comprise a higher content of Ni and Al than the aging precipitation γ' phase particles and have an average particle size of 2 to 40 μm.

8 Claims, 3 Drawing Sheets

(56) References Cited

OTHER PUBLICATIONS

Chinese-language Office Action issued in Chinese Application No. 202110434186.1 dated Dec. 8, 2021 with English translation (13 pages).

* cited by examiner

NI-BASED FORGED ALLOY ARTICLE AND TURBINE HIGH-TEMPERATURE MEMBER USING SAME

TECHNICAL FIELD OF THE INVENTION

The present invention relates to arts of a Ni (nickel)-based alloy for forging and, in particular, to an Ni-based alloy forged article which is excellent in mechanical properties at a high temperature and a turbine high-temperature member using the Ni-based alloy forged article.

DESCRIPTION OF BACKGROUND ART

In turbines (e.g., gas turbines and steam turbines) for aircrafts and thermal power plants, attaining higher temperature of the main fluid to increase thermal efficiency is now one of technological trends. Thus, improvement of mechanical properties of the turbine members at high temperatures is an important technical issue. Turbine high-temperature members (e.g., turbine rotor blades, turbine stator blades, rotor disks, combustor members, and boiler members) are exposed to the severest environments and repeatedly subjected to a rotation centrifugal force and vibration during turbine operation and to thermal stress associated with the start/stop of the operation. Therefore, improvement of mechanical properties (e.g., creep properties, tensile properties, and fatigue properties) is significantly important.

In order to satisfy various mechanical properties required, precipitation-strengthened Ni-based alloy materials have been widely used for turbine high-temperature members. Specifically, in the cases where high-temperature properties are essential, a high precipitation-strengthened Ni-based alloy material is used in which the percentage of a γ' (gamma prime) phase (e.g., $Ni_3(Al,Ti,Ta)$ phase) precipitated in a γ (gamma) phase matrix has been increased. An example of such high precipitation-strengthened Ni-based alloy material is an Ni-based alloy material wherein at least 30 volume percent (vol. %) of the γ' phase has been precipitated.

In order to achieve higher efficiency of turbines, it would be effective in responding to not only the above-mentioned trend toward higher main fluid temperatures, but also another trend toward expanding annulus areas by longer turbine blades (rotor blades and stator blades) and still another trend toward less flow loss of the main fluid by thinner turbine blades. Thus, longer and/or thinner turbine blades require turbine blade materials to have better tensile and fatigue properties.

Conventionally, in turbine blades, creep properties have been regarded as important. In order to meet the requirements for creep properties, Ni-based cast alloy articles manufactured by precision casting (uni-directional solidification or single crystalline solidification, in particular) have been often used. This is because when an alloy article contains fewer crystal grain boundaries transverse to the stress direction, it exhibits better creep properties.

On the other hand, in turbine discs and combustor components, tensile and fatigue properties are generally deemed more important than creep properties, so Ni-based forged alloy articles manufactured by hot forging have often been used. This is because when the crystal grain size is smaller (i.e. when the crystal grain boundary density is higher), the tensile and fatigue properties are better.

Here, when it comes to responding to the trend toward longer and thinner turbine blades, technical hurdles are extremely high in manufacturing longer and thinner turbine blades by uni-directional solidification or single crystalline growth, which is a cause for concern that the manufacturing yield of a turbine blade manufactured by uni-directional solidification or single crystalline solidification might become low significantly (i.e. the manufacturing costs might be significantly high). In other words, in terms of manufacturing costs, it is considered to be more advantageous to develop an article with adequate high-temperature properties (e.g. creep properties) required of turbine blades, based on a forged alloy article.

As mentioned above, in a precipitation-strengthening Ni-based alloy material, it is common to increase the volume fraction of the γ' phase in order to enhance its high-temperature properties. Unfortunately, however, a higher volume fraction of the γ' phase in a forged alloy article often leads to result in a lower manufacturing yield (or higher manufacturing costs) as it impairs workability and formability. Therefore, various studies have been carried out on techniques to stably manufacture a Ni-based forged alloy article as well as on techniques to improve the properties of a Ni-based forged alloy article.

For example, Patent Literature 1 (JP Hei 9 (1997)-302450 A) discloses a method of making Ni-based superalloy articles having a controlled grain size from a forging preform. The method includes the following steps of: providing an Ni-based superalloy preform having a recrystallization temperature, a γ'-phase solvus temperature and a microstructure comprising a mixture of γ and γ' phases, wherein the γ' phase occupies at least 30% by volume of the Ni-based superalloy; hot die forging the superalloy preform at a temperature of at least approximately 1600° F., but below the γ'-phase solvus temperature and a strain rate from approximately 0.03 to approximately 10 per second to form a hot die forged superalloy work piece; isothermally forging the hot die forged superalloy workpiece to form the finished article; supersolvus heat treating the finished article to produce a substantially uniform grain microstructure of approximately ASTM 6 to 8; and cooling the article from the supersolvus heat treatment temperature.

CITATION LIST

Patent Literature

Patent Literature 1: JP Hei 9 (1997)-302450 A, and
Patent Literature 2: JP 5869624 B2.

SUMMARY OF THE INVENTION

Problems to be Solved by the Invention

According to Patent Literature 1 (JP Hei 9 (1997)-302450 A), it seems to be possible to produce a forged article at a high production yield without cracking of the forged article even using a Ni-based alloy material in which the γ' phase occupies relatively high volume percent. However, because Patent Literature 1 conducts the hot die forging process with superplastic deformation at a low strain rate and the subsequent isothermally forging process, special production equipment as well as long work time is required (i.e., result in high equipment costs and high process costs). These would be the weak points of the technique taught in Patent Literature 1.

Since low production costs are strongly required for industrial products, it is one of high-priority issues to establish a technique to manufacture products at low costs.

For example, Patent Literature 2 (JP 5869624 B2) discloses a method for manufacturing a Ni-based alloy softened article made up of a Ni-based alloy material in which the solvus temperature of the γ' phase is 1050° C. or higher. The method includes a raw material preparation step to prepare a Ni-based alloy raw material to be used for the subsequent softening treatment step, and a softening treatment step to soften the Ni-based alloy raw material in order to increase processability. The softening treatment step is performed in a temperature range which is lower than the solvus temperature of the γ' phase. The softening treatment step includes a first substep to subject the Ni-based alloy raw material to hot forging at a temperature lower than the solvus temperature of the γ' phase, and a second substep to obtain a Ni-based alloy softened material containing 20 vol. % or more of incoherent γ' phase particles precipitated on grain boundaries of the γ phase (matrix of the Ni-based alloy) grains, by slowly cooling the above forged material from the temperature lower than the γ' phase solvus temperature at a cooling rate of 100° C./h or less. The technique taught in Patent Literature 2 seems to be an epoch-making technique that enables the processing and forming of the high precipitation-strengthening Ni-based alloy material at low costs.

The present inventors carried out further research based on the technique disclosed in Patent Literature 2 (JP 5869624 B2) and have found that in the case of a superhigh precipitation-strengthening Ni-based alloy material with a γ' phase volume fraction of 50% or more (e.g. a Ni-based alloy material enabling to precipitate 50 to 70 vol. % of γ' phase), it was difficult to control the first step above (the step of performing hot forging at a temperature lower than the solvus temperature of the γ' phase), and the manufacturing yield was prone to be low. In other words, further technical innovation was required.

From the viewpoints of recent energy conservation and global environmental protection, higher temperature of the main fluid and longer and/or thinner of the turbine blades for increasing thermal efficiency of turbines are expected to further progress. This means that environments where turbine high-temperature members are used could become more and more sever, and increased mechanical properties of the turbine high-temperature members will be further required. On the other hand, as stated above, achievement of low production costs is one of high-priority issues concerning industrial products.

The present invention was made in view of the foregoing and has an objective to provide a Ni-based forged alloy article based on a superhigh precipitation-strengthening Ni-based alloy material that has mechanical properties (tensile and creep properties, in particular) balanced at higher level than before, and a turbine high-temperature member formed of the Ni-based forged alloy article by a simple method that ensures a high manufacturing yield (in other words, at as low cost as possible).

Solution to Problems (I) According to one aspect of the present invention, there is provided a Ni-based forged alloy article that comprises crystal grains of the γ phase and precipitation particles of the γ' phase, and that has a chemical composition enabling to precipitate a γ' phase in an amount of 50 to 70 volume % at 700° C. within a matrix of a γ phase. The γ' phase comprises: aging precipitation γ' phase particles precipitating within the crystal grains of the γ phase; and eutectic reaction γ' phase particles precipitating between/among the crystal grains of the γ phase. The eutectic reaction γ' phase particles comprise a higher content of Ni and Al than the aging precipitation γ' phase particles and have an average particle size of 2 to 40 μm.

In the above aspect of a Ni-based forged alloy article (I), the following modifications and changes can be made.

(i) The eutectic reaction γ' phase particles may precipitate in an amount of 1 to 15 volume %.

(ii) The Ni-based forged alloy article may have a tensile strength of equal to or more than 1,200 MPa at room temperature and a creep rupture time of equal to or more than 100 hours at 780° C. at a stress of 500 MPa.

(iii) The chemical composition may consist of: 4.0 to 18 mass % of Cr (chromium); 2.0 to 25 mass % of Co (cobalt); 14 mass % or less of W (tungsten); 8.0 mass % or less of Mo (molybdenum); 2.0 to 7.0 mass % of Al; 8.0 mass % or less of Ti (titanium); 10 mass % or less of Ta (tantalum); 3.0 mass % or less of Nb (niobium); 3.0 mass % or less of Hf (hafnium); 2.0 mass % or less of Re (rhenium); 2.0 mass % or less of Fe (iron); 0.1 mass % or less of Zr (zirconium); 0.001 to 0.15 mass % of C (carbon); 0.001 to 0.1 mass % of B (boron); and a balance, the balance comprising Ni and inevitable impurities. Value P represented by a formula: "value $P=0.18\times$Al-content$+0.08\times$Ti-content$+0.03\times$Ta-content" may be equal to or more than 1.0.

(iv) The γ phase may have an average grain size of 15 to 200 μm.

(II) According to another aspect of the invention, there is provided a turbine high-temperature member that is formed of the above-described Ni-based forged alloy article.

In the above aspect of a turbine high-temperature member (II), the following modifications and changes can be made.

(v) The turbine high-temperature member may be a turbine blade, a combustor nozzle, a fixing pin, a bolt, or a coupon.

Advantages of the Invention

According to the invention, there can be provided a Ni-based forged alloy article based on a superhigh precipitation-strengthening Ni-based alloy material that has the tensile and creep properties balanced at higher level than before. Also, it is possible to provide a turbine high-temperature member formed of the Ni-based forged alloy article.

DETAILED DESCRIPTION OF THE PREFERRED EMBODIMENTS

Figure 1:
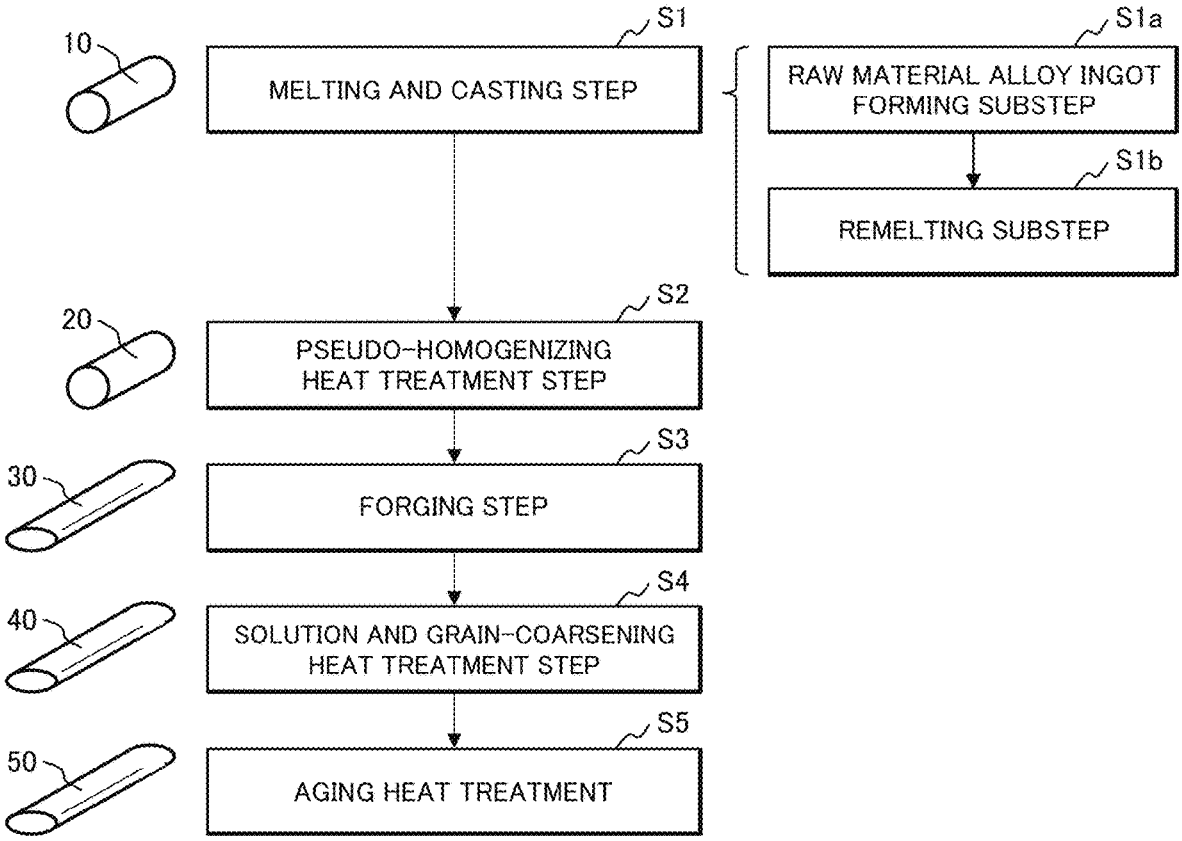
FIG. 1 is a process flow diagram illustrating a method for manufacturing a Ni-based forged alloy article according to an embodiment of the present invention.

[Initial Study and Basic Concept of Present Invention]

As mentioned above, a Ni-based cast alloy article with a large crystal grain size manufactured by uni-directional solidification or single crystalline solidification exhibits excellent creep properties, but it exhibits poor tensile and fatigue properties. In contrast, a Ni-based forged alloy article with a small crystal grain size manufactured by hot forging exhibits excellent tensile and fatigue properties, but it exhibits poor creep properties. In other words, a Ni-based cast alloy article and a Ni-based forged alloy article are opposite in their advantages.

On the other hand, in order to respond to the trends toward higher main fluid temperatures and/or toward longer and thinner turbine blades for improving turbine thermal efficiency, an article with creep properties and tensile properties that are balanced at higher level than conventional articles is required.

The present inventors focused their attention on the close correlation between the creep properties of a Ni-based alloy article and its resistance to sliding of the matrix crystal grain boundaries (so-called grain boundary strength). Furthermore, the inventors made an assumption that a forged alloy article with creep properties and tensile properties balanced at high level would be obtained by controlling the size of the matrix crystal grains (i.e. coarsening the recrystallized grains) while introducing precipitates for pinning the matrix crystal grain boundaries to prevent them from sliding. In addition, they conceived the idea of using γ' phase particles as the pinning precipitates to prevent the grain boundaries from sliding.

Based on the above assumption, the inventors carried out various experiments as initial study. The technique disclosed in Patent Literature 2 (JP 5869624 B2) was used as a method for precipitating γ' phase particles on grain boundaries of the matrix crystal grains. The final forming process was followed by heat treatment to control the size of the matrix crystal grains (i.e. coarsen the recrystallized grains) to improve creep properties. As a result, it was found that the γ' phase particles on the crystal grain boundaries dissolved in solid solution as the crystal grains coarsened, which resulted in a significantly less effect of pinning the grain boundaries (in other words, creep properties did not improve as expected).

Close examination and analysis of the initial study results have revealed that the γ' phase that precipitates in the temperature range of the hot forging in the technique disclosed in Patent Literature 2 (JP 5869624 B2), as well as the γ' phase that precipitates in the aging heat treatment, precipitates/crystallizes at relatively low temperatures. In other words, recrystallizing and coarsening the matrix crystal grains are difficult with an effective amount of grain boundary-pinning precipitates present as the solvus temperature of the γ' phase falls within a temperature range sufficiently lower than the eutectic temperature of the Ni-based alloy, and the heat treatment temperature suitable for recrystallizing and coarsening the matrix crystal grains is equal to or higher than the solvus temperature of the γ' phase.

So the inventors thermodynamically studied the manufacturing process of a Ni-based alloy material and closely reviewed it to find a precipitation phase with a solvus temperature falling within a temperature range higher than the heat treatment temperature suitable for recrystallizing and coarsening the matrix crystal grains. In doing so, they focused their attention on the γ' phase that crystallizes in association with eutectic reaction in a casting and solidification step for preparing a Ni-based alloy ingot (hereinafter referred to as "eutectic reaction γ' phase"). Since this eutectic reaction γ' phase precipitates/crystallizes in association with eutectic reaction, it naturally has a high solvus temperature. Meanwhile, in the present invention, the γ' phase that precipitates in the γ phase crystal grains by aging heat treatment is referred to as "aging precipitation γ' phase".

The eutectic reaction γ' phase is usually regarded as a harmful precipitation phase as it tends to form relatively large grains in the ingot, which easily become obstructive grains in the subsequent forging process. Therefore, in conventional techniques, this phase is removed by subjecting the ingot to homogenizing heat treatment (soaking) before the forging process.

The inventors focused their attention to this high solvus temperature of the eutectic reaction γ' phase and found a possible solution in intentionally leaving a certain amount of eutectic reaction γ' phase particles to remain while eliminating undesirable segregation of chemical components in the ingot so as to use the eutectic reaction γ' phase as pinning precipitates to prevent grain boundaries from sliding. They also conducted intensive research and study on the relationship among chemical composition, soaking conditions, microstructural forms, and mechanical properties in order to complete the present invention.

Preferred embodiments of the invention will be hereinafter described step by step of the manufacturing process of a Ni-based forged alloy article with reference to the accompanying drawings. However, the invention is not limited to the specific embodiments described below, and various combinations with known art and modifications based on known art are possible without departing from the spirit and the scope of the invention.

[Method for Manufacturing Ni-Based Forged Alloy Article]

FIG. 1 is a process flow diagram illustrating a method for manufacturing a Ni-based forged alloy article according to an embodiment of the invention. As shown in FIG. 1, the method for manufacturing a Ni-based forged alloy article of the invention includes a melting and casting step (S1), a pseudo-homogenizing heat treatment step (S2), a forging step (S3), a solution and grain-coarsening heat treatment step (S4) and an aging heat treatment step (S5). Each step will be hereinafter described more specifically.

(Melting and Casting Step)

In the melting and casting step S1, raw materials are melted to prepare a molten metal of desired alloy composition. The molten metal is then poured into an appropriate mold to form an alloy ingot 10. There is no particular limitation on the method for melting the raw materials and the casting method, and any conventional method for a Ni-based alloy material may be used.

In order to decrease the content of impurities in the alloy, such as phosphorous (P), sulfur (S), oxygen (O), and nitrogen (N), i.e. in order to increase the purity of the alloy, the melting and casting step S1 preferably includes a raw material alloy ingot forming substep S1*a* and a remelting substep S1*b*. In the raw material alloy ingot forming substep S1*a*, after a molten metal is formed, it is once solidified to form a raw material alloy ingot, and in the remelting substep S1*b*, the raw material alloy ingot is remelted to prepare a purified molten metal. There is no particular limitation on the remelting method as long as it is capable of increasing the purity of the ingot, but vacuum arc remelting (VAR) may be preferably used, for example.

A desirable alloy composition will be hereinafter described.

Cr: 4.0 Mass % to 18 Mass %

Cr has effects of dissolving itself into the γ phase as a solid solution and improving corrosion resistance at high temperatures. To obtain these effects, the Cr content should preferably be set at 4.0 mass % or more. By contrast, when the Cr content is over 18 mass %, a harmful phase (e.g. α-Cr phase) is prone to precipitate, which impairs creep properties. The Cr content is more preferably 6.0 mass % to 16 mass %, and even more preferably 8.0 mass % to 14 mass %.

Co: 2.0 Mass % to 25 Mass %

Co has effects of solid solution-strengthening the γ' phase (eutectic reaction γ' phase and aging precipitation γ' phase) and improving high-temperature corrosion resistance. To obtain these effects, the Co content should preferably be set at 2.0 mass % or more. On the contrary, when the Co content is over 25 mass %, precipitation of the γ' phase is inhibited, which impairs mechanical properties. The Co content is more preferably 5.0 mass % to 20 mass %, and even more preferably 8.0 mass % to 15 mass %.

W: 14 Mass % or Less

W has effects of solid solution-strengthening the γ phase and increasing the solvus temperature of the γ' phase (mainly, aging precipitation γ' phase) to improve creep properties. In the invention, the W is not an essential component, but it should preferably be incorporated for these effects. In contrast, when the W content is over 14 mass %, an undesirable phase (e.g. α-W phase) is prone to precipitate, which impairs creep properties, high-temperature corrosion resistance, and toughness. Also, due to its high density (high specific gravity), an excess presence of W renders the turbine high-temperature member heavy (which causes some disadvantages). Therefore, the W content is preferably 1.0 mass % to 12 mass %, and more preferably 4.0 mass % to 10 mass %.

Mo: 8.0 Mass % or Less

Mo, as is the case with W, has effects of solid solution-strengthening the γ phase and increasing the solvus temperature of the γ' phase (mainly, aging precipitation γ' phase) to improve creep properties. In the invention, the Mo is not an essential component, but it should preferably be incorporated for these effects. Alternatively, when the Mo content is over 8.0 mass %, oxidation resistance and high-temperature corrosion resistance are impaired. Therefore, the Mo content is preferably 0.5 mass % to 6 mass %, and more preferably 1.0 mass % to 4.0 mass %.

Al: 2.0 Mass % to 7.0 Mass %

Al is an essential component that forms the γ' phase, a precipitation-strengthening phase. For a desired amount of γ' phase to be formed, the Al content should preferably be set at 2.0 mass % or more. By contrast, when the Al content is over 7.0 mass %, an undesirable phase (e.g. σ phase and/or α-Cr phase) is prone to precipitate, which impairs mechanical properties and high-temperature corrosion resistance. Therefore, the Al content is preferably 2.5 mass % to 6.5 mass %, and more preferably 3.0 mass % to 6.0 mass %.

Ti: 8.0 Mass % or Less

Ti has effects of dissolving itself as a solid solution (substitutional solid solution) at Al sites of the γ' phase, contributing to improvement of mechanical properties and improving high-temperature corrosion resistance. In the invention, the Ti is not an essential component, but it should preferably be incorporated for these effects. On the contrary, when the Ti content is over 8.0 mass %, oxidation resistance is impaired. Therefore, the Ti content is preferably 1.0 mass % to 6.0 mass %, and more preferably 2.0 mass % to 5.0%.

Ta: 10 Mass % or Less

Ta, as is the case with Ti, has effects of dissolving itself as a solid solution (substitutional solid solution) at Al sites of the γ' phase and contributing to improvement of mechanical properties. In the invention, the Ta is not an essential component, but it should preferably be incorporated for these effects. In contrast, when the Ta content is over 10 mass %, an undesirable phase (e.g. σ phase) is prone to precipitate, which impairs creep properties. Therefore, the Ta content is preferably 2.0 mass % to 8.0 mass %, and more preferably 3.0 mass % to 6.0 mass %.

Nb: 3.0 Mass % or Less

Nb, as is the case with Ti, has effects of dissolving itself as a solid solution (substitutional solid solution) at Al sites of the γ' phase and contributing to improvement of mechanical properties. In the invention, the Nb is not an essential component, but it may be incorporated for these effects. Alternatively, when the Nb content is over 3.0 mass %, an undesirable phase (e.g. σ phase and/or η phase) is prone to precipitate, which impairs creep properties. Therefore, the Nb content is preferably 2.0 mass % or less, and more preferably 1.0 mass % or less.

Hf: 3.0 Mass % or Less

Hf has an effect of improving the adhesion of a protective coating (e.g. $Cr_2O_3$ and $Al_2O_3$) formed on a surface of the Ni-based alloy article to improve high-temperature corrosion resistance and oxidation resistance. In the invention, the Hf is not an essential component, but it may be incorporated for this effect. By contrast, when the Hf content is over 3.0 mass %, the melting point of the Ni-based alloy material decreases, which impairs creep properties. Therefore, the Hf content is preferably 2.0 mass % or less, and more preferably 1.5 mass % or less.

Re: 2.0 Mass % or Less

Re, as is the case with W, has effects of solid solution-strengthening the γ phase and improving corrosion resistance. In the invention, the Re is not an essential component, but it may be incorporated for these effects. On the contrary, when the Re content is over 2.0 mass %, an undesirable phase is prone to precipitate, which impairs mechanical properties. Also, since the Re is an expensive element, increasing its content involves increasing the cost of the alloy article. Therefore, the Re content is preferably 1.5 mass % or less.

Fe: 2.0 Mass % or Less

Fe is higher in ductility than Ni and has an effect of improving hot workability. Also, since the Fe is an element less expensive than other elements, use of the Fe has a material cost-reducing effect. In the invention, the Fe is not an essential component, but it may be incorporated for this effect. In contrast, when the Fe content is over 2.0 mass %, the thermal stability of the γ' phase decreases, which impairs creep properties. Therefore, the Fe content is preferably 1.0 mass % or less.

Zr: 0.1 Mass % or Less

Zr has effects of segregating to the crystal boundaries of the γ phase and enhancing the grain boundary strength. In the invention, the Zr is not an essential component, but it should preferably be incorporated for these effects. Alternatively, when the Zr content is over 0.1 mass %, an undesirable phase (e.g. $Ni_3Zr$ phase) is prone to precipitate, which decreases ductility. Therefore, the Zr content is preferably 0.005 mass % to 0.08 mass %, and more preferably 0.01 mass % to 0.05 mass %.

C: 0.001 Mass % to 0.15 Mass %

C has effects of segregating to the crystal boundaries of the γ phase to form carbide particles and enhancing the grain boundary strength. To obtain these effects, the C content should preferably be set at 0.001 mass % or more. By contrast, when the C content is over 0.15 mass %, an excessive amount of carbide particles is formed, which impairs creep properties, ductility and corrosion resistance. Also, excessive carbide particles are prone to cause casting defects. Therefore, the C content is preferably 0.01 mass % to 0.12 mass %, and more preferably 0.02 mass % to 0.1 mass %.

B: 0.001 Mass % to 0.1 Mass %

B has effects of segregating to the crystal boundaries of the γ phase to form boride particles and enhancing the grain boundary strength. To obtain these effects, the B content should preferably be set at 0.001 mass % or more. On the contrary, when the B content is over 0.1 mass %, the applicable temperature range for the solution treatment in the manufacturing process becomes narrow, which leads to impaired creep properties. Therefore, the B content is preferably 0.005 mass % to 0.08 mass %, and more preferably 0.01 mass % to 0.04 mass %.

Balance: Ni and Inevitable Impurities

Ni is one of the main components and has the largest content. The inevitable impurities refer to impurities that are extremely difficult to avoid, and the content of which should be decreased as much as possible. They include Si (silicon), Mn (manganese), P, S, O, and N. 0.01 mass % or less of Si, 0.02 mass % or less of Mn, 0.01 mass % or less of P, 0.01 mass % or less of S, 0.005 mass % or less of 0, and 0.005 mass % or less of N are within the acceptable contamination range.

$$\text{value } P = 0.18\times\text{Al-content} + 0.08\times\text{Ti-content} + 0.03\times\text{Ta-content}, \text{ value } P \geq 1.0 \qquad \text{Formula:}$$

Value P is a parameter that affects the amount of γ' phase precipitates. In order to achieve 50 volume % or more of γ' phase precipitates at 700° C., the alloy composition should preferably be controlled such that value P is 1.0 or more. Value P is more preferably 1.1 or more.

For a desired amount of eutectic reaction γ' phase precipitates to be left to remain in the subsequent pseudo-homogenizing heat treatment step and the forging step, the eutectic reaction γ' phase preferably has a solvus temperature of 1,100° C. or higher, and more preferably 1,180° C. or higher. In other words, the alloy composition should preferably be controlled such that eutectic reaction γ' phase with such a solvus temperature precipitates.

(Pseudo-Homogenizing Heat Treatment Step)

In the pseudo-homogenizing heat treatment step S2, the alloy ingot 10 prepared in the melting and casting step S1 is subjected to a soaking treatment to eliminate undesirable segregation of chemical components. The pseudo-homogenizing heat treatment step S2 in the invention is largely characterized by preparation of a pseudo-homogenized alloy ingot 20 in which the eutectic reaction γ' phase crystalized in the ingot 10 has intentionally been left to remain to some extent.

The amount of eutectic reaction γ' phase to be left to remain in the pseudo-homogenized alloy ingot 20 should preferably be controlled to be 1 volume % to 15 volume %, and more preferably 1 volume % to 8 volume %. When the amount of eutectic reaction γ' phase is less than 1 volume %, the effect of pinning the grain boundary sliding of the γ phase grains in the finished Ni-based forged alloy article becomes insufficient. In contrast, when the amount of eutectic reaction γ' phase is over 15 volume %, the amount of aging precipitation γ' phase in the finished Ni-based forged alloy article decreases and the effect of precipitation-strengthening becomes insufficient.

In order to control the remaining amount of eutectic reaction γ' phase while eliminating undesirable segregation in the alloy ingot 10, the soaking treatment should preferably be performed as heat treatment at 1,140 to 1,260° C. Also, in order to suppress change in the amount of γ' phase precipitates during cooling after the heat treatment as much as possible, the alloy ingot 10 should preferably be allowed to quickly pass a temperature range in which γ' phase (aging precipitation γ' phase) easily precipitates (1,260 to 700° C., in particular). Preferred cooling methods include air cooling, gas cooling, and water cooling.

In the step S2, form and size of the eutectic reaction γ' phase particles are strongly affected by the melting and casting step S1. So, the eutectic reaction γ' phase particles present in the pseudo-homogenized alloy ingot 20 usually have an extensive size distribution of around 1 μm to 100 μm.

Figure 2:
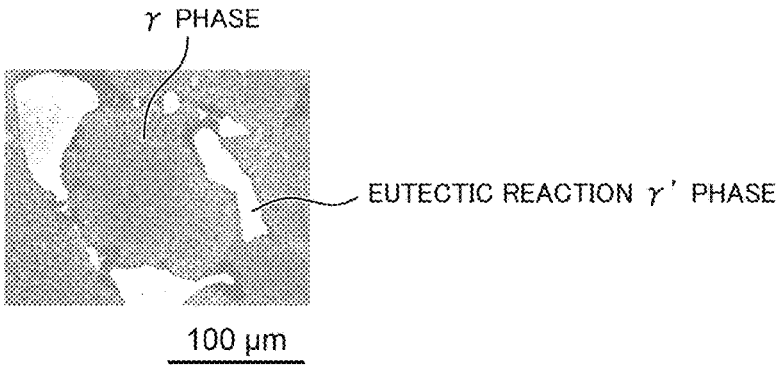
FIG. 2 is a scanning electron microscope image of a sectional microstructure of a pseudo-homogenized alloy ingot according to an embodiment of the invention.

FIG. 2 is a scanning electron microscope image (SEM image) of a sectional microstructure of the pseudo-homogenized alloy ingot 20 according to the embodiment of the invention. As shown in FIG. 2, the eutectic reaction γ' phase particles with an extensive size distribution are precipitated between/among crystal grains of the γ phase that constitutes the matrix.

(Forging Step)

In the forging step S3, the pseudo-homogenized alloy ingot 20 is subjected to forging to form a forged article 30 having a desired shape. There is no particular limitation on the forging method, and any conventional method (e.g. hot forging, warm forging, and cold forging) may be used. However, as for the forging temperature, the temperature range in which the γ' phase easily precipitates should be avoided as much as possible.

Also, the forging in the invention may include die forging, extruding, rolling, upsetting, stamping, ironing, and drawing.

As described above, the pseudo-homogenized alloy ingot 20 mainly include the γ phase and the eutectic reaction γ' phase, and the particles of the eutectic reaction γ' phase have an extensive size distribution of around 1 μm to 100 μm. Subjecting such a pseudo-homogenized alloy ingot as the pseudo-homogenized alloy ingot 20 to forging causes pulverization and dispersion of larger-sized eutectic reaction γ' phase particles as the forging process progresses. At the same time, the eutectic reaction γ' phase particles pin the γ phase crystal grain boundaries and prevent their movement due to plastic working. As a result, the forged article 30 has a microstructure in which the eutectic reaction γ' phase particles bite into the γ phase crystal grains on the γ phase crystal grain boundaries.

The average size of the eutectic reaction γ' phase particles in the forged article 30 is preferably 2 μm to 40 μm, more preferably 3 μm to 30 μm, and even more preferably 5 μm to 25 μm. When the average size of the eutectic reaction γ' phase particles is less than 2 μm, the effect of pinning the γ phase crystal grain boundaries in the finished Ni-based forged alloy article becomes insufficient. On the contrary, when the average size of the eutectic reaction γ' phase particles is over 40 μm, the number of the eutectic reaction γ' phase particles becomes so small that the effect of pinning the γ phase crystal grain boundaries in the finished Ni-based forged alloy article becomes insufficient.

Meanwhile, in the present invention, the possibility is not denied that the forged article 30 includes, in addition to the eutectic reaction γ' phase, precipitation phases such as the aging precipitation γ' phase, η phase, carbide phase, and boride phase which have precipitated during the step S3.

(Solution and Grain Coarsening Heat Treatment Step)

In the solution and grain-coarsening heat treatment S4, the forged article 30 is subjected to heat treatment at a relatively high temperature to cause precipitation phases other than the eutectic reaction γ' phase to enter into solution while recrystallizing and coarsening the crystal grains of the γ phase to prepare a recrystallized and coarsened article 40. The heat treatment in the step S4 is preferably performed at a temperature equal to or higher than the solvus temperature of the aging precipitation γ' phase and lower than the solvus temperature of the eutectic reaction γ' phase (substantially, less than the eutectic temperature of the Ni-based alloy material).

In the case where hot forging is performed in the preceding forging step S3 and as a result the forged article 30 is fully recrystallized and coarsened, this step S4 may be omitted. In that case, the forged article 30 is treated as the recrystallized and coarsened article 40 as is. In contrast, in the case where the recrystallization and coarsening by the hot forging is insufficient or where warm forging or cold forging is performed, this step S4 should preferably be conducted on the forged article 30.

In the step S4, the remaining particles of the eutectic reaction γ' phase pin the crystal grain boundaries of the γ phase and prevent their movement during recrystallization of the γ phase crystal grains. In other words, the γ phase crystal grains recrystallize and coarsen with particles of the eutectic reaction γ' phase left to remain on the crystal grain boundaries of the γ phase. Specifically, when the amount of eutectic reaction γ' phase precipitates is relatively small, the average grain size of the γ phase is relatively large. When the amount of eutectic reaction γ' phase particles is relatively large, the average grain size of the γ phase is relatively small.

More specifically, the average grain size of the γ phase is preferably 15 μm to 200 μm, more preferably 30 μm to 180 μm, and even more preferably 50 μm to 150 μm. When the average grain size of the γ phase is less than 15 μm, it becomes difficult to achieve satisfactory creep properties in the finished Ni-based forged alloy article. On the contrary, when the average grain size of the γ phase is over 200 μm, it becomes difficult to achieve satisfactory tensile properties in the finished Ni-based forged alloy article.

(Aging Heat Treatment Step)

In the aging heat treatment step S5, the recrystallized and coarsened article 40 is subjected to an aging heat treatment to precipitate aging precipitation γ' phase particles within the γ phase crystal grains. By this step, a Ni-based forged alloy article 50 according to the embodiment of the invention can be obtained. There is no particular limitation on the heat treatment conditions in this step S5, and any conventional condition (e.g. 600 to 1,100° C.) may be applied.

As has been described above, one of the major features of the Ni-based forged alloy article 50 according to the embodiment of the invention is inclusion of the pseudo-homogenizing heat treatment step S2 of preparing the pseudo-homogenized alloy ingot 20 in its manufacturing method, which requires no special manufacturing equipment. In other words, the present invention has an advantage in that it makes it possible to obtain a Ni-based forged alloy article based on a superhigh precipitation-strengthening Ni-based alloy material at a manufacturing yield that is comparable to those of conventional Ni-based forged alloy articles (i.e. without involving any particular cost increase).

[Product Formed of Ni-Based Forged Alloy Article]

Figure 3:
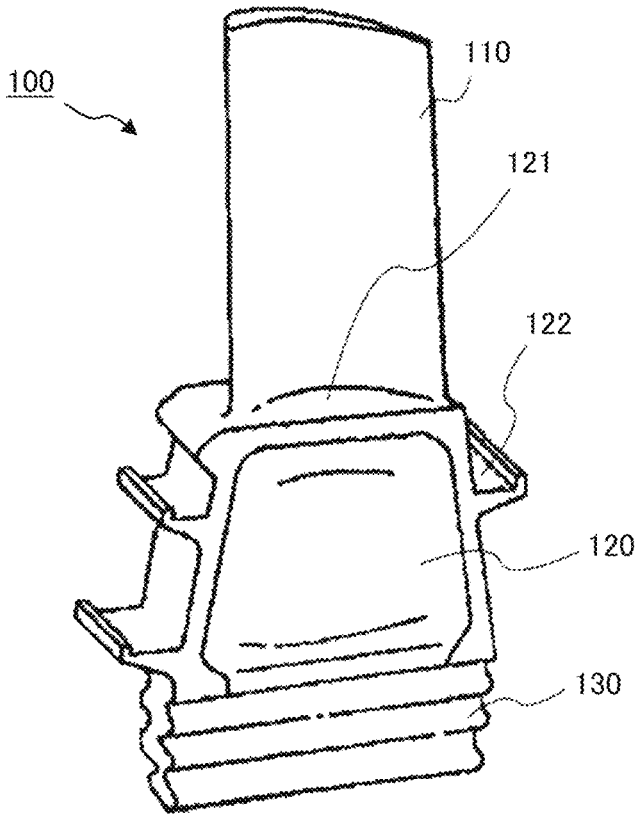
FIG. 3 is a schematic illustration showing a perspective view of a turbine rotor blade as a turbine high-temperature member according to another embodiment of the invention.

FIG. 3 is a schematic illustration showing a perspective view of a turbine rotor blade as a turbine high-temperature member according to another embodiment of the invention. As shown in FIG. 3, a turbine rotor blade 100 schematically includes a blade portion 110, a shank 120, and a root portion (or dovetail) 130. The shank 120 includes a platform 121 and radial fins 122. In the case of a gas turbine, the size of a conventional turbine rotor blade (length in the longitudinal direction in the figure) is around 10 to 100 cm, and the weight is around 1 to 10 kg.

The turbine rotor blade 100 according to the embodiment of the invention has a microstructure in which eutectic reaction γ' phase particles are present between/among crystal grains of the γ phase, which serves as the matrix, together with aging precipitation γ' phase particles, precipitated within crystal grains of the γ phase. This microstructure allows it to have mechanical properties that include tensile properties and creep properties balanced at higher level than conventional rotor blades. As a result, it is capable of responding to the trends toward higher main fluid temperatures, longer turbine blades and thinner ones for improved turbine thermal efficiency.

Figure 4:
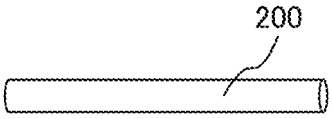
FIG. 4 is a schematic illustration showing a perspective view of a fixing pin as a turbine high-temperature member according to an embodiment of the invention.
Figure 5:
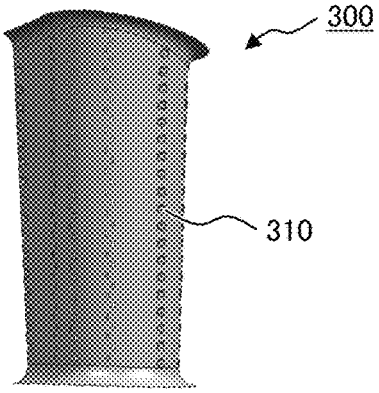
FIG. 5 is a schematic illustration showing a perspective view of a coupon as a turbine high-temperature member according to an embodiment of the invention.

FIG. 4 is a schematic illustration showing a perspective view of a fixing pin as a turbine high-temperature member according to the embodiment of the invention. In the case that a screw thread is formed on the fixing pin 200 shown in FIG. 4, it can be used as a bolt. FIG. 5 is a schematic illustration showing a perspective view of a coupon as a turbine high-temperature member according to the embodiment of the invention. The coupon 300 shown in FIG. 5 has cooling holes 310 and can be used as a front edge coupon of a turbine stator blade.

As with the turbine rotor blade 100 above, the fixing pin 200, the bolt, and the coupon 300 of the present invention have mechanical properties that include tensile properties and creep properties balanced at higher level than conventional ones, which allows them to contribute to improving turbine thermal efficiency.

EXAMPLES

The present invention will be described below in further detail on the basis of examples. However, the invention is not limited to the specific examples described herein, but may include their variations.

[Experimental 1]

(Fabrication of Alloy Ingots AI-1 to AI-8)

Alloy ingots AI-1 to AI-8 having the nominal chemical compositions shown in Table 1 were fabricated according to the melting and casting step S1 described before. In Table 1, "Bal." in the Ni column indicates inclusion of inevitable impurities. Also, "-" in Table 1 indicates no intentional addition.

TABLE 1

Nominal Chemical Compositions of Alloy Ingots AI-1 to AI-8 (unit: mass %).

| | Ni | Cr | Co | W | Mo | Al | Ti | Ta | Nb | Hf | Re | Fe | Zr | C | B | Value P |
|---|---|---|---|---|---|---|---|---|---|---|---|---|---|---|---|---|
| AI-1 | Bal. | 10.1 | 6.9 | 6.0 | 1.6 | 4.3 | 3.4 | 4.8 | 0.5 | — | — | — | 0.02 | 0.07 | 0.01 | 1.2 |
| AI-2 | Bal. | 8.3 | 9.3 | 9.4 | 0.5 | 5.6 | 0.7 | 3.2 | — | 1.4 | — | — | 0.01 | 0.08 | 0.02 | 1.2 |
| AI-3 | Bal. | 6.8 | 10.5 | 11.8 | 0.9 | 5.2 | — | 3.7 | 0.8 | 1.5 | 1.4 | — | — | 0.07 | 0.02 | 1.1 |
| AI-4 | Bal. | 13.1 | 9.7 | 4.5 | 1.7 | 4.0 | 2.4 | 4.9 | — | — | — | 0.3 | 0.03 | 0.08 | 0.02 | 1.1 |
| AI-5 | Bal. | 12.3 | 23.9 | 1.2 | 2.7 | 2.5 | 6.9 | — | — | — | — | — | 0.03 | 0.02 | 0.02 | 1.0 |
| AI-6 | Bal. | 13.2 | 10.0 | 4.6 | 1.7 | 3.6 | 2.5 | 7.7 | — | — | — | — | 0.02 | 0.05 | 0.02 | 1.1 |
| AI-7 | Bal. | 13.2 | 10.0 | 4.6 | 1.7 | 4.0 | 2.5 | 5.7 | — | — | — | — | 0.03 | 0.07 | 0.02 | 1.1 |
| AI-8 | Bal. | 15.6 | 8.4 | 2.6 | 3.0 | 2.3 | 3.5 | — | 1.1 | — | — | 3.9 | 0.03 | 0.02 | 0.01 | 0.7 |

Value P = 0.18 × Al-content + 0.08 × Ti-content + 0.03 × Ta-content.

As shown in Table 1, the alloy ingots AI-1 to AI-7 satisfy the specifications for chemical composition according to the embodiment of the invention. On the contrary, the alloy ingot AI-8 fails to satisfy the specifications for value P according the embodiment of the invention.

[Experimental 2]

(Preparation of Pseudo-Homogenized Alloy Ingots HI-1 to HI-7 and Fully-Homogenized Alloy Ingots HI-8 to HI-11)

Pseudo-homogenized alloy ingots HI-1 to HI-7 that include the eutectic reaction γ' phase particles intentionally left to remain were prepared according to the pseudo-homogenizing heat treatment step S2 described before. Also, fully-homogenized alloy ingots HI-8 to HI-11 in which the γ' phase had been fully dissolved in solution by conventional homogenizing heat treatment were prepared.

The specifications of the pseudo-homogenized alloy ingots HI-1 to HI-7 and the fully-homogenized alloy ingots HI-8 to HI-11 are shown in Table 2. The equilibrium volume fraction of the γ' phase at 700° C. was calculated using JMatPro, a material physical value calculation software available from UES Software Asia, and thermodynamic database. Also, the volume fraction of the eutectic reaction γ' phase was calculated by performing image analysis on an SEM image of a sectional microstructure (see FIG. 2, for example) using ImageJ, a public-domain image processing software developed at the National Institutes of Health (NIH).

TABLE 2

Specifications of Pseudo-Homogenized Alloy Ingots HI-1 to HI-7 and Fully-Homogenized Alloy Ingots Hl-8 to HI-11.

| Pseudo-homogenized alloy ingot/ Fully-homogenized alloy ingot | Alloy ingot | Value P | Equilibrium volume fraction of γ' phase at 700° C. | Volume fraction of eutectic reaction γ' phase |
|---|---|---|---|---|
| HI-1 | AI-1 | 1.2 | 67% | 6% |
| HI-2 | AI-2 | 1.2 | 68% | 8% |
| HI-3 | AI-3 | 1.1 | 64% | 12% |
| HI-4 | AI-4 | 1.1 | 57% | 5% |
| HI-5 | AI-5 | 1.0 | 55% | 4% |
| HI-6 | AI-6 | 1.1 | 58% | 2% |
| HI-7 | AI-7 | 1.1 | 59% | 2% |
| HI-8 | AI-2 | 1.2 | 68% | 0% |
| HI-9 | AI-4 | 1.1 | 57% | 0% |
| HI-10 | AI-5 | 1.0 | 55% | 0% |
| HI-11 | AI-8 | 0.7 | 37% | 0% |

As shown in Table 2, the pseudo-homogenized alloy ingots HI-1 to HI-7 each has value P of 1.0 or more and a γ' phase equilibrium volume fraction of 50 volume % or more. Also, they all have some eutectic reaction γ' phase left to remain. FIG. 2 shown before is an SEM image of a sectional microstructure of the pseudo-homogenized alloy ingot HI-3. Furthermore, the other pseudo-homogenized ingots were separately observed to have a sectional microstructure similar to FIG. 2.

In contrast, the fully-homogenized alloy ingots HI-8 to HI-10, based respectively on the alloy ingots AI-2, AI-4, and AI-5, have no eutectic reaction γ' phase left to remain, although each has value P of 1.0 or more and a γ' phase equilibrium volume fraction of 50 volume % or more at 700° C. Also, the fully-homogenized alloy ingot HI-11 has value P of less than 1.0 and a γ' phase equilibrium volume fraction of less than 50 volume %, and it has no eutectic reaction γ' phase left to remain.

[Experimental 3]

(Fabrication of Ni-Based Forged Alloy Articles FA-1 to FA-11)

The pseudo-homogenized alloy ingots HI-1 to HI-7 and the fully-homogenized alloy ingots HI-8 to HI-11 prepared in Experimental 2 were subjected to the forging step S3 to the aging heat treatment step S5 described before, thus fabricating Ni-based forged alloy articles FA-1 to FA-11. Specifically, as the forging step S3, hot forging was performed at a temperature equal to or higher than the solvus temperature of the aging precipitation γ' phase and lower than the eutectic temperature of the Ni-based alloy material (at a forging ratio of 2 or more). As the solution and grain-coarsening heat treatment step S4, heat treatment was performed in which the ingots were held at the same temperature as the hot forging. As the aging heat treatment S5, heat treatment was performed in which the ingots were held at 800° C.

[Experimental 4]

(Microstructural Observation and Mechanical Properties Measurement of Ni-Based Forged Alloy Articles FA-1 to FA-11)

The microstructural observation was conducted using a scanning electron microscope-energy dispersive X-ray spectroscopy (SEM-EDX) analyzer. The obtained SEM images were subjected to image analysis using an image processing software (ImageJ) to calculate the average grain size of the γ phase and the average particle size of the eutectic reaction γ' phase. The results are shown in Table 3 below.

Figure 6:
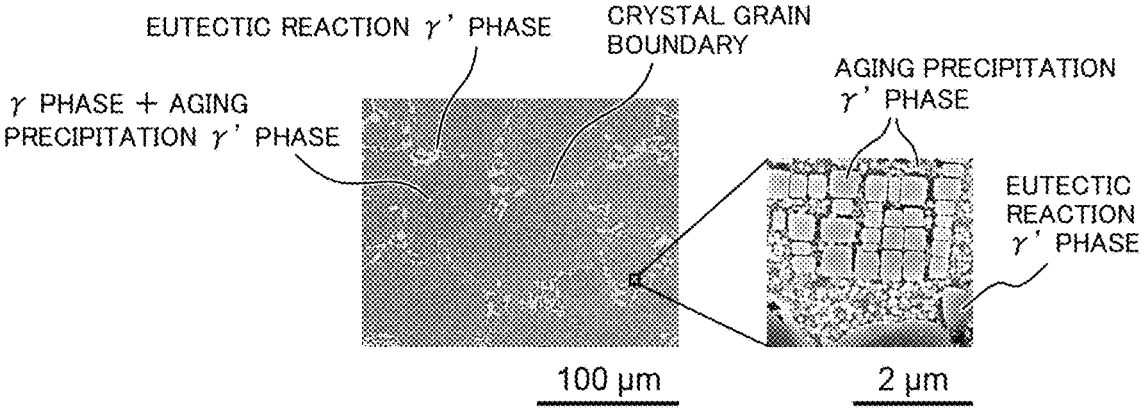
FIG. 6 is a scanning electron microscope image of a sectional microstructure of a Ni-based forged alloy article according to an embodiment of the invention.

FIG. 6 is an SEM image of a sectional microstructure of the Ni-based forged alloy article FA-2 based on the pseudo-homogenized alloy ingot HI-2. As shown in FIG. 6, the Ni-based forged alloy article FA-2 according to the embodiment of the invention has a microstructure in which the eutectic reaction γ' phase particles are precipitated between/ among the γ phase crystal grains, and the aging precipitation γ' phase particles are precipitated within the γ phase crystal grains. The other Ni-based forged alloy articles (FA-1, FA-3 to FA-7) were separately observed to have a similar microstructure.

Figure 7:
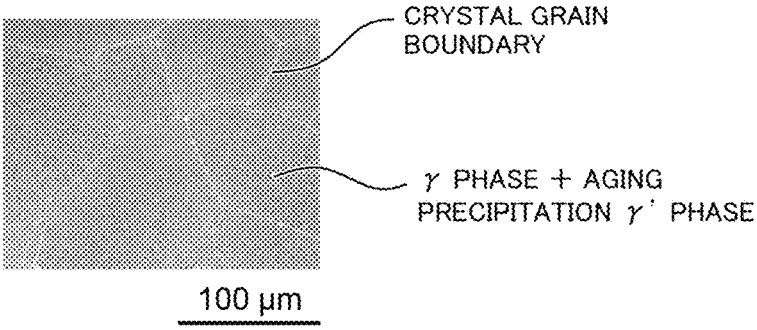
FIG. 7 is a scanning electron microscope image of a sectional microstructure of a Ni-based forged alloy article departed from an embodiment of the invention.

FIG. 7 is an SEM image of a sectional microstructure of the Ni-based forged alloy material FA-8 based on the fully-homogenized alloy ingot HI-8. As shown in FIG. 7, the Ni-based forged alloy material FA-8 has a microstructure in which the aging precipitation γ' phase particles are precipitated within the γ phase crystal grains, but eutectic reaction γ' phase particles are not precipitated between/among the γ phase crystal grains (i.e. a conventional microstructure). The other Ni-based forged alloy articles based on the fully-homogenized alloy ingots (FA-9 to FA-11) were separately observed to have a similar microstructure.

Measurements of the mechanical properties were conducted as follows. First, a creep test was carried out at 780° C. at a stress of 500 MPa to measure the creep rupture time. Considering the properties required of a turbine high-temperature member to which the invention relates, a creep rupture time of equal to or more than 100 hours is judged as "pass", and a creep rupture time of less than 100 hours is judged as "fail". Creep properties to be judged as pass means the creep rupture time reaching 100,000 hours at 650° C. or higher. Such creep properties can be regarded as comparable to those of a Ni-based alloy article manufactured by unidirectional solidification. The results are shown in Table 3.

Second, a tensile test was conducted at room temperature in conformity with JIS Z 2241 to measure the tensile strength as tensile properties. Considering the properties required of a turbine high-temperature member to which the invention relates, a tensile strength of 1,200 MPa or more is required. Therefore, a tensile strength of equal to or more than 1,200 MPa is judged as "pass", and a tensile strength of less than 1,200 MPa is judged as "fail". The results are shown in Table 3.

As shown in Table 3, the Ni-based forged alloy articles FA-1 to FA-7 according to the embodiment of the invention are judged as pass both for creep properties and tensile properties. On the contrary, the Ni-based forged alloy articles FA-8 to FA-10, each of which has a conventional microstructure, do not satisfy the passing requirement for creep properties, although they are based on the same alloy ingots as the Ni-based forged alloy articles FA-2, 4 and 5 of the invention. Also, the Ni-based forged alloy article FA-11 based on the alloy ingot AI-8, whose equilibrium volume fraction of the γ' phase at 700° C. is less than 50 volume %, is judged as fail both for creep properties and tensile properties.

Based on the results of Experimental 4, it has been confirmed that a Ni-based forged alloy article according to the embodiment of the invention, having a microstructure in which the eutectic reaction γ' phase particles are precipitated on the crystal grain boundaries of the γ phase, has creep properties and tensile properties balanced at high level.

[Experimental 5]

(Composition Analysis of γ Phase, Aging Precipitation γ' Phase, and Eutectic Reaction γ' Phase)

The pseudo-homogenized alloy ingots HI-1 to HI-7 prepared in Experimental 2 were subjected to an overaging treatment to prepare test pieces for composition analysis, each including coarsened aging precipitation γ' phase particles with a particle size of around 5 μm. Each test piece was subjected to an SEM-EDX analyzer to analyze the chemical composition of its γ phase, aging precipitation γ' phase, and eutectic reaction γ' phase.

Specifically, the chemical composition of each phase was analyzed at ten locations and the average of the ten results was obtained. The analyzed elements were eight elements, Ni, Cr, Co, W, Mo, Al, Ti and Ta, and the calculation was conducted considering the total of the eight elements as 100 mass %. The results for the chemical composition analysis test piece based on the pseudo-homogenized alloy ingot HI-2 are shown in Table 4.

TABLE 3

Specifications and Mechanical Properties Measurement Results of Ni-based Forged Alloy Articles FA-1 to FA-11.

| Ni-based forged alloy article | Pseudo-homogenized alloy ingot/ fully-homogenized alloy ingot | Alloy ingot | Average grain size of γ phase (μm) | Average particle size of eutectic reaction γ' phase (μm) | Creep rupture time (h) | Tensile strength (MPa) |
|---|---|---|---|---|---|---|
| FA-1 | HI-1 | AI-1 | 78 | 24 | 884 | 1323 |
| FA-2 | HI-2 | AI-2 | 50 | 17 | 265 | 1226 |
| FA-3 | HI-3 | AI-3 | 59 | 12 | 234 | Unmeasured |
| FA-4 | HI-4 | AI-4 | 54 | 9 | 267 | 1200 |
| FA-5 | HI-5 | AI-5 | 64 | 15 | 198 | 1307 |
| FA-6 | HI-6 | AI-6 | 15 | 2 | 157 | 1209 |
| FA-7 | HI-7 | AI-7 | 17 | 3 | 134 | 1206 |
| FA-8 | HI-8 | AI-2 | 84 | 0 | 86 | 1210 |
| FA-9 | HI-9 | AI-4 | 7 | 0 | 86 | 1333 |
| FA-10 | HI-10 | AI-5 | 16 | 0 | 36 | Unmeasured |
| FA-11 | HI-11 | AI-8 | 336 | 0 | 60 | 1086 |

TABLE 4

Composition Analysis Results for γ Phase, Aging Precipitation γ' Phase, and Eutectic Reaction γ' Phase of Pseudo-Homogenized Alloy Ingot HI-2 (mass %).

| | Ni | Cr | Co | W | Mo | Al | Ti | Ta |
|---|---|---|---|---|---|---|---|---|
| γ phase | 56.2 | 15.6 | 13.7 | 10.7 | 0.8 | 2.5 | 0.3 | 0.2 |
| Aging precipitation γ' phase | 70.6 | 3.5 | 7.0 | 7.6 | 0.4 | 6.6 | 1.0 | 3.3 |
| Eutectic reaction γ' phase | 74.8 | 3.9 | 7.3 | 1.3 | 0.4 | 7.6 | 1.4 | 3.3 |

As shown in Table 4, the aging precipitation γ' phase and the eutectic reaction γ' phase each contains a higher fraction of Ni, Al, Ti and Ta than the γ phase of the matrix. Also, comparison between the aging precipitation γ' phase and the eutectic reaction γ' phase reveals that the eutectic reaction γ' phase contains a higher fraction of Ni, Al and Ti and a lower fraction of W than the aging precipitation γ' phase. This difference would be attributable to a difference in the precipitation mechanisms of the aging precipitation γ' phase, which precipitates from the γ phase, and the eutectic reaction γ' phase, which eutectically precipitates from the liquid phase. Also, this difference in the chemical compositions would be considered to result in a difference in solvus temperatures.

It was separately confirmed that similar composition analysis results were obtained with the composition analysis test pieces based on the other pseudo-homogenized alloy ingots HI-1 and HI-3 to HI-7. Meanwhile, no particular difference in the Ti content was found between the aging precipitation γ' phase and the eutectic reaction γ' phase as for the test piece based on the pseudo-homogenized alloy ingot HI-3, which did not contain the Ti.

The above-described embodiments and Examples have been specifically given in order to help with understanding on the present invention, but the invention is not limited to the described embodiments and Examples. For example, a part of an embodiment may be replaced by known art, or added with known art. That is, a part of an embodiment of the invention may be combined with known art and modified based on known art, as far as no departing from a technical concept of the invention.

LEGEND

10 . . . alloy ingot;
20 . . . pseudo-homogenized alloy ingot;
30 . . . forged article;
40 . . . recrystallized and coarsened article;
50 . . . Ni-based forged alloy article;
100 . . . turbine rotor blade;
110 . . . blade portion;
120 . . . shank;
121 . . . platform;
122 . . . radial fin;
130 . . . root portion;
200 . . . fixing pin;
300 . . . coupon; and
310 . . . cooling hole.

The invention claimed is:

1. A Ni-based forged alloy article, comprising crystal grains of a γ phase and precipitation particles of a γ' phase, and having a chemical composition enabling to precipitate the γ' phase in an amount of 50 to 70 volume % at 700° C. within a matrix of the γ phase, wherein the chemical composition consists of:
4.0 to 18 mass % of Cr;
2.0 to 25 mass % of Co;
6.0 to 14 mass % of W;
8.0 mass % or less of Mo;
2.0 to 7.0 mass % of Al;
8.0 mass % or less of Ti;
10 mass % or less of Ta;
3.0 mass % or less of Nb;
3.0 mass % or less of Hf;
2.0 mass % or less of Re;
2.0 mass % or less of Fe;
0.1 mass % or less of Zr;
0.001 to 0.15 mass % of C;
0.001 to 0.1 mass % of B; and
a balance, the balance consisting of Ni and inevitable impurities,
wherein value P represented by a formula: "value P=0.18×A1-content+0.08×Ti-content+0.03×Ta-content" is equal to or more than 1.0,
wherein the γ phase has an average grain size of 15 to 200 μm,
wherein the γ' phase comprises:
aging precipitation γ' phase particles precipitating within the crystal grains of the γ phase; and
eutectic reaction γ' phase particles precipitating between/among the crystal grains of the γ phase, the eutectic reaction γ' phase particles precipitating in an amount of 1 to 15 volume %, and
wherein the eutectic reaction γ' phase particles comprise a higher content of Ni and A1 than the aging precipitation γ' phase particles and have an average particle size of 2 to 40 μm.

2. The Ni-based forged alloy article according to claim 1, wherein
the Ni-based forged alloy article has a tensile strength of equal to or more than 1,200 MPa at room temperature and a creep rupture time of equal to or more than 100 hours at 780° C. at a stress of 500 MPa.

3. A turbine member formed of the Ni-based forged alloy article according to claim 1.

4. The turbine member according to claim 3, wherein
the turbine member is a turbine blade, a combustor nozzle, a fixing pin, a bolt, or a coupon.

5. A Ni-based forged alloy article, comprising crystal grains of a γ phase and precipitation particles of a γ' phase, and having a chemical composition enabling to precipitate the γ' phase in an amount of 50 to 70 volume % at 700° C. within a matrix of the γphase,
wherein the chemical composition consists of:
4.0 to 18 mass % of Cr;
2.0 to 9.7 mass % of Co;
14 mass % or less of W;
8.0 mass % or less of Mo;

2.0 to 7.0 mass % of Al;
8.0 mass % or less of Ti;
2.0 to 10 mass % of Ta;
3.0 mass % or less of Nb;
1.4 to 3.0 mass % of Hf;
2.0 mass % or less of Re;
2.0 mass % or less of Fe;
0.1 mass % or less of Zr;
0.001 to 0.15 mass % of C;
0 001 to 0.1 mass % of B; and a balance, the balance consisting of Ni and inevitable impurities, wherein value P represented by a formula: "value P=0.18×A1-content+0.08×Ti-content+0.03×Ta-content" is equal to or more than 1.0, wherein the γ phase has an average grain size of 15 to 200 μm, wherein the γ' phase comprises:

aging precipitation γ' phase particles precipitating within the crystal grains of the γ phase; and eutectic reaction γ' phase particles precipitating between/among the crystal grains of the γ phase, the eutectic reaction γ' phase particles precipitating in an amount of 1 to 15 volume %, and wherein the eutectic reaction γ' phase particles comprise a higher content of Ni and Al than the aging precipitation γ' phase particles and have an average particle size of 2 to 40 μm.

6. The Ni-based forged alloy article according to claim 5, wherein the Ni-based forged alloy article has a tensile strength of equal to or more than 1,200 MPa at room temperature and a creep rupture time of equal to or more than 100 hours at 780° C. at a stress of 500 MPa.

7. A turbine member formed of the Ni-based forged alloy article according to claim 5.

8. The turbine member according to claim 7, wherein the turbine member is a turbine blade, a combustor nozzle, a fixing pin, a bolt, or a coupon.

* * * * *